US011707131B2

(12) United States Patent
Bishop

(10) Patent No.: US 11,707,131 B2
(45) Date of Patent: Jul. 25, 2023

(54) APPARATUS FOR SMOOTHING TEETH BY RUBBING AWAY TINY TOOTH SURFACE IRREGULARITIES THEREBY ENHANCING THEIR SHINE AND GLOSS

(71) Applicant: Nickey Bishop, Austin, TX (US)

(72) Inventor: Nickey Bishop, Austin, TX (US)

( * ) Notice: Subject to any disclaimer, the term of this patent is extended or adjusted under 35 U.S.C. 154(b) by 0 days.

(21) Appl. No.: 17/849,666

(22) Filed: Jun. 26, 2022

(65) Prior Publication Data

US 2022/0346539 A1 Nov. 3, 2022

Related U.S. Application Data

(63) Continuation-in-part of application No. 17/080,738, filed on Oct. 26, 2020, now abandoned.
(Continued)

(51) Int. Cl.
*A46B 9/00* (2006.01)
*A46B 7/04* (2006.01)
(Continued)

(52) U.S. Cl.
CPC ..... *A46B 9/005* (2013.01); *A46B 5/0016* (2013.01); *A46B 5/0095* (2013.01); *A46B 7/042* (2013.01);
(Continued)

(58) Field of Classification Search
CPC ..... A46B 9/005; A46B 5/0016; A46B 7/046; A46B 9/04; A46B 2200/3086;
(Continued)

(56) References Cited

U.S. PATENT DOCUMENTS 323,305 A 7/1885 Evans
1,473,000 A * 11/1923 Weatherwax ..... A46B 3/005 15/210.1
(Continued)

FOREIGN PATENT DOCUMENTS

DE 102006003895 A1 * 8/2007 ..... A61C 17/22
DE 202007014252 * 11/2017 ..... A46B 7/04

OTHER PUBLICATIONS

Lake Dental Clinic, "What is Dental Adehsive", Mar. 16, 2018, https://www.lakedentalclinic.com/blog/what-is-a-dental-adhesive/. (Year: 2018).*

*Primary Examiner* — Laura C Guidotti

(57) ABSTRACT

An apparatus for removing scratches from tooth enamel configured like a toothbrush that has buffing material where the toothbrush has bristles. Configured in several different iterations so as to comprise a toothbrush shaped instrument that provides ways to attach buffing material. One iteration places the buffing material over the head. Another iteration includes a pad between the head and the buffing material in three buffing surfaces each one of flat, concave, and convex. The pad and buffing material configured severally to facilitate mating to the neck of the apparatus by known methods. The head further including an integrated head portion, pad, and buffing material in one of flat, concave, and convex shapes that attach to the neck and handle. The user places the buffing material against the teeth and moves the apparatus back and forth to buff the surfaces and smooth the enamel.

13 Claims, 9 Drawing Sheets

Related U.S. Application Data

(60) Provisional application No. 62/932,400, filed on Nov. 7, 2019.

(51) Int. Cl.
*A46B 5/00* (2006.01)
*A47L 13/12* (2006.01)

(52) U.S. Cl.
CPC ..... *A47L 13/12* (2013.01); *A46B 2200/1066* (2013.01); *A46B 2200/3086* (2013.01)

(58) Field of Classification Search
CPC . A46B 2200/1066; A61C 15/02; A61C 15/00; A47L 13/12
See application file for complete search history.

(56) References Cited

U.S. PATENT DOCUMENTS 1,504,365 A * 8/1924 Mayhood ..... A46B 9/005 15/231
1,513,178 A * 10/1924 Mayhood ..... A46B 7/04 15/210.1
1,559,519 A * 10/1925 Thomas ..... A46B 15/0055 15/210.1
1,901,419 A * 3/1933 Steinert ..... A46B 9/005 15/210.1
2,443,461 A 6/1948 Kempster
2,719,315 A * 10/1955 Sheehan ..... A46B 7/04 15/210.1
5,944,519 A 8/1999 Griffiths
6,336,461 B1 1/2002 Martinez
6,510,576 B1 * 1/2003 Gruber ..... A46B 15/0081 15/210.1
7,607,188 B2 10/2009 Singhal
8,549,693 B2 10/2013 Gruber et al.
2002/0127513 A1 9/2002 Bachmann et al.
2003/0168075 A1 9/2003 Schwartz
2005/0138741 A1 6/2005 Singhal
2016/0066682 A1 * 3/2016 Jalalian ..... A46B 9/005 15/114

* cited by examiner

APPARATUS FOR SMOOTHING TEETH BY RUBBING AWAY TINY TOOTH SURFACE IRREGULARITIES THEREBY ENHANCING THEIR SHINE AND GLOSS

The present application is a continuation-in-part of U.S. patent application Ser. No. 17/080,738, filed Oct. 26, 2020; which claims the benefit of U.S. Provisional Application No. 62/932,400, filed Nov. 7, 2019; all of which are incorporated herein by reference.

FIELD OF THE INVENTION

The present invention generally relates to an apparatus to compliment and finish the process of caring for and maintaining teeth after brushing and flossing. More specifically, the present invention relates to an apparatus comprising a fine abrasive material (buffing material) used with a handle capable of remove removing microscopic irregularaties, herein and henceforth called "scratches," a toothbrush would have left on the surface of the enamel after brushing. The apparatus smooths/buffs the teeth with enough pressure and force to affect the enamel and make the teeth smoother.

BACKGROUND OF THE INVENTION

The inventor here applying for a patent discovered the apparatus in pursuit of an alternative to a popular dentifrice known as Pearl Drops. Pearl Drops smooth the teeth so effectively the advertising promoting the product included an actor passing the tongue over the teeth after brushing with it to emphasize the improved smoothness created. The effect was desirable to the inventor and Pearl Drops was used for a long time. The smoothing effect was obvious and desirable. The teeth felt better, stayed clean longer, and looked better.

Smooth surfaces do not hold things well. So, teeth scratched during brushing or eating hold particles and chemicals while providing purchase and habitat for microbes. Smoother teeth stay clean longer and stain less. Perl Drops smoothed the teeth. Eventually, the loss of tooth enamel became a fear that prompted the inventor to try to accomplish similar results without the Pearl Drops. The fact that moving the enamel into the microscopic scratches would not remove enamel but would smooth the surfaces of the teeth as well as the Pearl Drops dentifrice eventually led to the current invention.

As a trained painter, buffing was a well understood process in fine finishes of surfaces. Even polishing the paint of a car included and cloth buffing. The idea came to see if a similar effect could be attained for teeth.

The first effort was simply using a washcloth over a finger and passed over the front teeth using a bit of force. The results were satisfactory but attempting to do that same for the rest of the teeth with a washcloth proved problematic. Choking and gagging resulted, and it was not possible to reach some of the teeth. This led to the idea of removing the bristles from a toothbrush and attaching a bit of cloth to the place where the bristles had been. It was soon evident that the bit of cloth had to be rather thin and secured firmly enough to prevent movement such as deforming, wrinkling, bunching, and slipping. Further, it had to remain on the head of the device. A different method was found to secure another bit of material to the handle well enough to effectively buff the outer surface of all the teeth. This led to other conceptions such as, bending the buffing material in concave and convex fashion to use on the front teeth on both the insides and outsides of the teeth. Practical consideration further brought to light the interchangeable head portion currently disclosed. It eventually became clear that a new invention had been discovered.

In time, the apparatus was refined. Securing the buffing material was a vital requirement. As a user of various sanding tools, it was obvious to the inventor that the buffing material would have to be held firmly in place like the sandpaper of electric sanding devices all do it. If the sandpaper slips or bunches, the operation must stop, and a new piece of sandpaper installed.

Securing the cloth to the modified toothbrush revealed yet another difficulty. The method of securing the buffing material were too large and obtrusive and did not feel good in the mouth. The device hit various places inside the mouth and sometimes hurt a bit. So, a smoother and a less obtrusive method was found. It was crude but effective.

A wide flat rubber band wound tightly around the end of a sleeve, or "sack," where it contacted the narrow part of the toothbrush, herein and heretofore known as the "neck," of material into which the handle was inserted was effective. From there, the current apparatus was further developed.

It was realized that there should be several interchangeable head portions, that the buffing material should be changeable without difficulty, and that there could be many variations to the design that would open the door to patents for similar apparatuses designed a bit differently. This application attempts to preempt such infringement. Therefore, there are several iterations of the same device that will accomplish the same results. They are explained in the specifications and the figures. The Claims also claim the variations.

Caring for teeth has always been an important aspect of life for people. In the late eighteen hundreds dental floss came to be used and has been developed since. Despite the immenseness of the task, dental floss has become a standard tool in most homes. The promotion of the product did it. The current invention stands as the next instrument to be adopted by humanity.

People began to use a bristle brush we know as a toothbrush to clean their teeth around 1938, though various forms of natural things were used throughout history, even in ancient times. The toothbrush and dental floss have become household items found in homes all around the world. Getting people to use dental floss must have been a difficult task, but it was done. This invention will follow dental floss into the customary tools used in the homes of a large percentage of the population. The present invention seeks to compliment the inventions that have been adopted by humanity in the care of their teeth. The inventor envisions the toothbrush holder displaying the toothbrushes next to this invention. The inventor calls the device a "toothbuff."

Professionals who prepare and care for surfaces of fine quality and softness such as pianos and violins have long since realized that brushing scratches the surfaces and when used require a buffing to smooth the scratches and create a lustrous and clean surface that sheds dirt and other contaminants. It is known that brushing requires buffing in all other fields of finishing. Dentists advise patients to avoid the toothbrushes classified as "hard bristle," saying they scratch the enamel too much. They concede that all toothbrushes scratch the teeth advising that the "soft bristle" brushes are tolerable. This is made more rational by their advice to come to the dental professionals for routine cleaning and polishing. Clearly, a gap exists in the maintenance of teeth.

The need and even the necessity for a device to use after brushing teeth is a long existent gap that the current invention seeks to fill. The gap has existed nearly a hundred years since the invention of the toothbrush. The current invention is the first logical invention to complete the tools needed to care for teeth since the invention of the toothbrush and dental floss.

Searching the existent patents reveals many efforts to improve the tools of dental hygiene, but none are designed to move enamel without removing much of it. The inventor has not found a single devise designed to do what this invention is designed to do, namely, smooth the surfaces of teeth. None of the dental hygiene instruments currently disclosed are capable of being applied to affect a buffing conveniently and comfortably to all the surfaces of all the teeth in all the many arrangements in the human mouths. Some cannot possible be used on all the surfaces of all manner of human teeth and teeth arrangements. Some could possible be used to accomplish a small degree of smoothing effect, but none are designed to be used on all surfaces and none were designed specifically for that purposes. The device here disclosed reveals a device that moves the enamel like a sculptor moves the clay over scratches and blemishes in the clay sculpting. Even painters do the same when painting.

Finally, the device presented here smooths the flatter and more reachable surfaces of the teeth. To address the surfaces between the teeth another iteration of the device is included. It can buff the surfaces between the teeth and around the rounded surfaces between them. It will augment the smoothing effects of using dental floss. The damage that occurs to teeth on the surfaces between the teeth is a particularly difficult problem even for professional dentists. The inventor has experienced frustration expressed by dentists caused by the inability to address decay between the teeth. So far, they offer only radical grinding the permanently damages the tooth. This iteration of the device will provide a new method to address that problem. It will benefit the user by preventing and/or reducing decay and plaque between the teeth.

The frequent use of the toothbrush has caused dentists and other professional dental care personnel to advise people to use a soft bristle toothbrush to minimise scratching the enamel of the teeth and to minimise the loss of gum tissue. They have not offered a method to routinely buff the scratches created by brushes in the home. The current invention is designed to augment and complete process of caring for one's teeth by brushing and flossing by providing a convenient and inexpensive way to remove the scratches a toothbrush puts on the surfaces of teeth and other irregularities caused by other means such as eating.

People use toothbrushes to brush their teeth. Toothbrushes generally comprise bristles that operate in a reciprocating motion i.e., back and forth or up and down motion and clean the teeth. The bristles scratch an enamel of the teeth and result in micro-abrasions that remains on the teeth after brushing. Repeated brushing with a toothbrush erodes tooth enamel making the micro-abrasions worse over time. The micro-abrasions provide habitat for bacteria and bacterial deposits on the enamel which are difficult to clean by subsequent brushing. If left untreated for a long time, the micro-abrasions cause decay and reduces the beauty and feel of the teeth. As the abrasions worsen with repeated use of a brush, staining and decaying often occurs. Over the time, it becomes impossible to preserve the beauty and health of teeth. Millions of people lose their teeth before the need for them ends. False teeth are a global result of not caring for teeth and caring for them improperly over a period of time. The best effort to care for the teeth requires the same procedures all who are familiar with the art of quality finishing of surfaces use, a buffing and polishing as a finishing step. The apparatus as described herein is the logical next step after brushing the teeth and flossing between them.

In order to overcome the above problem, dentists recommend professional polishing of teeth in the dentist's office. Tooth polishing smoothes the surface of teeth and reduces extrinsic stains, removes dental plaque accumulation, and increases aesthetics. Generally, dentists recommend polishing teeth once or twice a year depending on the oral condition of a patient. Dentists use a small electric tool with a soft rubber cup and polishing paste for polishing the teeth. If the patient has severe stain, an air polishing system, which is a jet of pressurised air and water mixed with an abrasive agent, might be used to polish the teeth. Stains that cannot be removed by the polishing are being treated with a bleaching process. Both procedures are made more necessary with repeated brushing without smoothing, or buffing, the teeth after brushing.

Several devices for cleaning and polishing teeth have been disclosed in the past. One such example is disclosed in a United States Publication No. 2003/0168075, entitled "Finger shaped tooth polisher" (the "'075 Publication"). The '075 Publication discloses a tooth polisher that includes an elastic finger shaped finger cloth having two opposing sides for fitting tightly over a finger. A rough cloth is disposed on a first of said opposing sides polishes the teeth. A chamois cloth on the other of said opposing sides is soft and is used to buff the teeth after polishing with the rough cloth. A finger pull tab connects to said finger cloth between said rough cloth and said chamois cloth and allows the tooth polisher to be rotated to orient the rough cloth and chamois cloth. Here is an example that acknowledges the need to buff the teeth.

Another example is disclosed in a U.S. Pat. No. 8,549,693 entitled "Tooth cleaning device" (the "'693 Patent"). The '693 Patent discloses a tooth cleaning device comprising a handle, and a pad coupled to the handle, wherein the pad has a front face, a back face and a plurality of side walls. There are a plurality of different areas disposed on the front face of the pad comprising a first area comprising a first set of protrusions, in a substantially semi-spherical shape, and a second area comprising a second set of protrusions in a substantially conical shape. There is also a third area of protrusions formed as a substantially conical shape, and a fourth area of protrusions formed as a substantially semi-spherical shape. The device can be formed as a pad which collapses voluntarily under pressure. There is no mention of buffing because the device could not buff the teeth.

Yet another example is disclosed in a United States Publication No. 2002/0127513, entitled "Hygiene instrument for cleaning and polishing the surface of the teeth and the composite materials of dental fillings" (the "'513 Publication"). The '513 Publication discloses a hygiene instrument for removing stains, cleaning and polishing the surface of the teeth and the composite materials of dental fillings. The structure of the hygiene instrument is made up of fibers and optionally a load of particles embedded in a resinous matrix giving the working surface of the hygiene instrument a continuous abrasive power. This patented instrument depends on a polishing agent. The currently disclosed instrument needs no polishing agent.

Yet another example is disclosed in a United States granted patent No. 2005/0138741, entitled "Integrated Apparatus For Teeth Cleaning" (the "'741 Publication"). The '741 Publication discloses six different teeth cleaning aspects in one teeth cleaning apparatus. These aspects are: (i) use of an abrasive surface supported by a pad that is rubbed for cleaning exposed and easily reachable part of the teeth, (ii) use of bristles for reaching spaces between teeth and gum lines and between two teeth, (iii) use of a sponge under the abrasive surface that delivers plaque cleaning and anti-bacterial agent to the teeth surface, (iv) use of a woven cloth like surface with the ability to absorb and remove the food/acid film from the teeth, (v) ability to clean teeth with little or no use of water, (vi) use of a one-time throw away cleaning head for better hygiene. The current invention reaches all surfaces of teeth and has no bristles or other parts that scratch teeth.

Yet another example is disclosed in a U.S. Pat. No. 2,443,461 entitled "Teeth Cleaning and Polishing Applicator" (the "'461 Patent"). The '461 Patent discloses an instrument that has portions corresponding in shape to the gingival curvature and surfaces of the teeth. This instrument deforms when applied to the teeth. It cannot apply the buffing effect required to successfully smooth teeth.

Yet another example is disclosed in a U.S. Pat. No. 6,336,461 entitled "Teeth Cleaning Device" (the "'461 Patent"). The '461 Patent discloses a tooth cleaning device for cleaning teeth of plaque without using a toothbrush having bristles thereon. The tooth cleaning device includes a tubular member that is elongated and has a first end and a second end. The first end is open for accessing an interior of the tubular member. The second end is closed and has a generally convex shape. The tubular member comprises a cloth material. An elongated implement movably extends into the first end of the tubular member, such that the tubular member rubs against the teeth of user. This instrument does not buff the enamel and cannot be applied to all tooth surfaces. Cleaning and buffing are different process.

Polishing devices disclosed in the above disclosures are complex, expensive, and designed differently. They are not specialised devices that serve the simple purpose of the invention disclosed herein. Additionally, polishing by some of the polishing devices discussed above removes too much material from the enamel. Some include brushes and some are unpleasant to use. Given the location of teeth and the difficulties of applying a devise to the ones at the back of the mouth, some of the above devices will cause choking and gagging reflex in the attempt to reach all the teeth and all their surfaces.

Therefore, there is a need for an apparatus that is simple, easy to use on all the teeth and all their surfaces, and capable of holding a buffing material in a comfortable and convenient arrangement that will not be uncomfortable, hang, snag, cause choking and gagging reflex or injure the user. This will prevent neglect caused by inconvenience, difficulty, time, discomfort, and fear of injury. In as much as it is commonly known that people tend to omit regular hygienic procedures necessary to prolong the health and life of teeth while maintaining their appearance the apparatus disclosed here has none of the discouraging characteristics that further the omission of competent care steps.

BRIEF SUMMARY OF THE INVENTION

The present invention solves the above discussed problems inexpensively and conveniently without difficulty, discomfort, injury, gagging, or choking. The present invention discloses an apparatus that provides a noticeably smoother tooth surface and brighter appearance. The apparatus reduces staining and prevents staining. It makes the teeth feel better to the tongue and lips. With continual use from childhood, teeth will be healthy longer and look better, and require less dental help by professionals. The apparatus provides an obvious and natural next development in the care of teeth. The disclosed invention requires no additional substances or dentifrice. The apparatus operates in a wet or dry condition and removes the necessity of polishing compounds used with other devices but works best in a dry condition. The use of dentifrice such as popularly used toothpastes reduces or destroys the buffing effect and should not be used with the apparatus when maximum effect is desired. To simply wash the teeth and mouth, the device can be used wet and with a dentifrice. It cannot replace the efficacy of a toothbrush, however. Further, it is not the intended purpose or use of the apparatus. It can be used to improve the conditions of the teeth and mouth when a toothbrush is unavailable. It further comprises a composition of hydrophobic and slick surfaces to which the buffing material is attached making sanitation easy and providing gentle, injury free contact with the mouth.

It is an object of the present invention to provide an apparatus for manipulating tooth enamel in a way to make it smooth, herein called "buffing" the surface, and remove irregularities such as scratches created by brushing from teeth and that avoids the drawback of known polishing systems and tools. It can also be produced with a toothbrush on the other end. It will conduce better care of the teeth and reduce dental problems including recessing gums, while giving the teeth a glossy and bright appearance.

In order to achieve the object, the present invention provides a technical feature in which the apparatus includes a handle, a neck, a head, and a buffing material mounted tightly to the head. The buffing material removes tiny scratches and irregularities in the enamel.

The present invention disclosed an apparatus similar to a toothbrush that has a buffing material where the toothbrush has bristles. It comprises an elongated handle, a narrow neck section, a head portion, and a buffing material. The buffing material is manufactured using one of a variety of cloths and other substances. The buffing material is formed into a sack slightly smaller than the head portion that has tails or drawstrings at the opening. The head portion is forced into the sack of buffing material conforming tightly to the shape of the head and secured to the neck by tying the tails or strings to it then securing the ends with the tying method or tucking them beneath the tails, strings, or the sack of buffing material. The sack of buffing material is open on one end and closed like any other sack at the opposite end. Pushing the entire apparatus into the sack of buffing material all the way to the closed end of the sack and securing it with the tails or strings affords the user an apparatus that can be used on all surfaces of human teeth using a plurality of surfaces of buffing material. The sack can be washed and/or replaced as the user determines. This embodiment of the invention herein disclose a single apparatus for buffing all human teeth on all surfaces in all the different sizes and shapes of mouths along with all the many tooth sizes and arrangements with a washable and disposable buffing material. It can be used safely in mouths that have had dental repairs or dental process installed such as fillings, crowns, and implants common to dentistry. It must not be used on retainers, bridges, or other dental appliances that can snag the device.

In order to buff teeth, a user uses the apparatus after brushing the teeth with a toothbrush and flossing. The teeth are thereby clean making buffing possible. User has a choice to use the apparatus in a dry or wet condition to buff the teeth, but it works best when used dry. The user places the buffing material against the teeth and moves the buffing material back and forth over the surface of the teeth to remove tiny scratches that the toothbrush would have left on the surface of the enamel and other irregularities created by other means. Further, the buffing material diminishes stains on the teeth. Further, buffing diminishes stains and shines the teeth more lustrously with continued use. Buffing with the herein disclosed instrument ensures no damage to gums and stimulates blood circulation in the gums. This provides an advantage over an existing polishing tool which damage the gums.

In yet another iteration of the present invention, a single long handle has a thin end section that has a thin and tiny amount of buffing material bonded to it. The end section and buffing material are thin enough to pass between the teeth just below where they are closest near the tops.

A further iteration of the device provides a bent or hooked or tip-like structure such that the buffing material allows to buff the back of the back teeth, back molars and/or wisdom teeth.

In one technical feature of the present invention, the apparatus includes a handle, in which one end consists of buffing material and another end consists of bristles. As such, the bristles allow to brush the teeth. Subsequently, the user turns the handle and uses the buffing material to buff the teeth.

In one technical feature of the present invention, the apparatus includes a motor, a battery and a tool coated or mounted with a buffing material. The tool oscillates, rotates and vibrates to buff the teeth using the buffing material. The apparatus provides actuators at the handle for operating the tool at varied speed.

In one advantageous feature of the present invention, the apparatus removes the scratches from the teeth and reduces the chances of accumulation of dental deposits and, thereby, reduces the effort and time required to conduct daily, sometime multiple treatments by brush, dental floss, and buffing treatments per day. When done after every meal as recommended by professionals in the dental field, the easy use of the apparatus disclosed herein makes the process faster, easier, and more effective over time.

Also, the addition of the apparatus here disclosed to the set of tools used daily in caring for one's teeth can assist people when they see their dentist for regular professional care. This is an additional advantageous effect of the present invention. The apparatus reduces the amount of help the professionals will need to provide. Anyone familiar with the art of professional dentistry will appreciate the benefits their patients receive by the use of the presently disclosed apparatus. Their work will be reduced with each visit as the use of the apparatus continues over time.

Dental carries, tooth failures, and staining are caused by the compounds that occurs naturally in the mouth. Reducing the ability of the tooth enamel to retain them reduces the dental problems that require more drastic procedures. This is yet another advantageous effect of the present invention.

Features and advantages of the invention hereof will become more apparent in light of the following detailed description of selected embodiments, as illustrated in the accompanying FIGS. As will be realized, the invention disclosed is capable of modifications in various respects, all without departing from the scope of the invention. Accordingly, the drawings and the description are to be regarded as illustrative in nature.

BRIEF DESCRIPTION OF THE DRAWINGS

The present invention will now be described with reference to the drawings, which are provided as illustrative examples of the invention as to enable those skilled in the art to practice the invention. It will be noted that throughout the appended drawings, within each drawing like features are identified by like reference numerals. The FIGS. and examples are not meant to limit the scope of the present invention to a single embodiment, but other embodiments are possible by way of interchange of some or all of the described or illustrated elements and, further, wherein.

DETAILED DESCRIPTION OF THE EMBODIMENTS

Figure 1A:
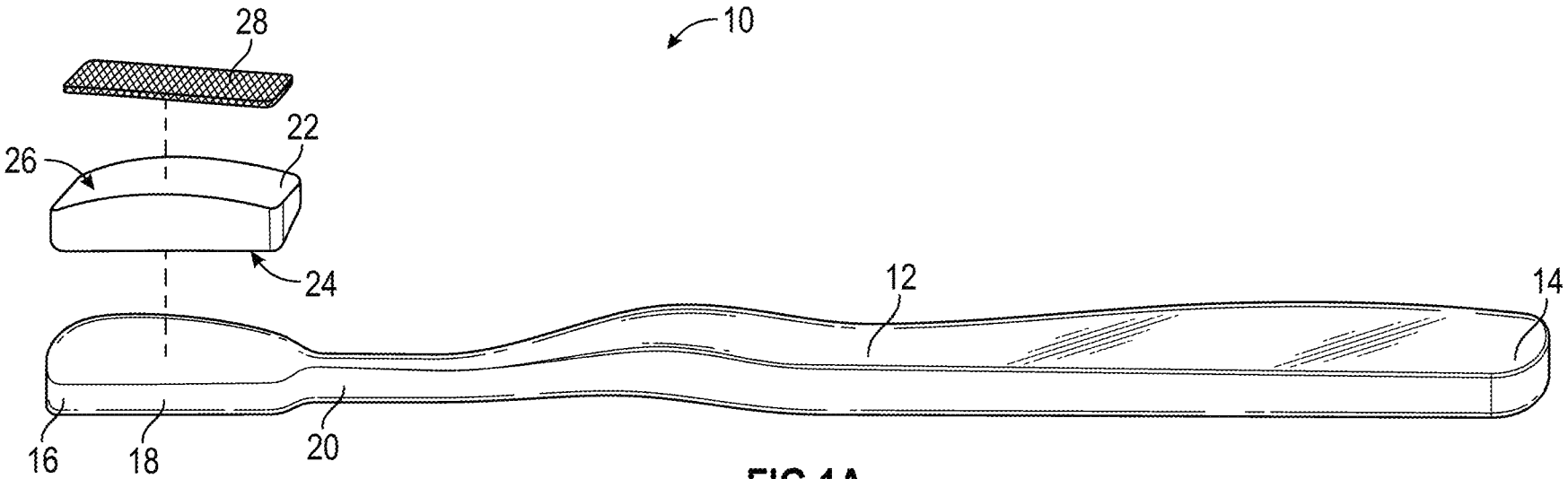
FIGS. 1A through 2B illustrate various embodiments of an apparatus for buffing teeth.

The detailed description set forth below in connection with the appended drawings is intended as a description of exemplary embodiments in which the presently disclosed invention may be practiced. The term "exemplary" used throughout this description means "serving as an example, instance, or illustration," and should not necessarily be construed as preferred or advantageous over other embodiments. The detailed description includes specific details for providing a thorough understanding of the presently disclosed apparatus for tooth buffing and polishing. However, it will be apparent to those skilled in the art that the presently disclosed invention may be produced without these specific details without changing the character and quality of the apparatus. In some instances, well-known structures and devices are shown in functional or conceptual diagram form in order to avoid obscuring the concepts of the presently disclosed apparatus.

In the present specification, an embodiment showing a singular component should not be considered limiting. Rather, the invention preferably encompasses other embodiments including a plurality of the same component, and vice-versa, unless explicitly stated otherwise herein. Moreover, the applicant does not intend for any term in the specification to be ascribed an uncommon or special meaning unless explicitly set forth as such. Further, the present invention encompasses present and future known equivalents to the known components referred to herein by way of illustration.

Although the present invention provides a description of an apparatus for buffing and occasionally washing teeth, it is to be further understood that numerous changes may arise in the details of the embodiments of the apparatus for buffing teeth. It is contemplated that all such changes and additional embodiments are within the spirit and true scope of this invention.

It should be understood that the present invention describes an apparatus for buffing teeth. The apparatus includes a handle, a neck, a head, a pad, and a buffing material in various configurations. The handle provides an elongated body. The neck provides a smaller section to accommodate the narrow spaces between the teeth and cheek and the teeth and lips. The head portion provides a mounting surface for the buffing material, and in another embodiment, a pad with premounted buffing material and in yet another embodiment a pad with the capacity to remove and replace the buffing material. The pad comprises a bottom portion and a top portion. The bottom portion has a flat configuration and the top portion has a flat or concave or convex configuration. The buffing material mounts at the top surface of the pad, and as a result the buffing material takes the shape of the top surface of the pad. The bottom portion removably mounts to the handle. In another iteration the head, pad, and buffing material is a unit that removably mounts to the neck by known means. The apparatus allows to buff the teeth after brushing the teeth with a toothbrush. User uses the apparatus in a dry condition. User holds the handle and places the buffing material against the teeth and moves the buffing material back and forth over the surface of the teeth to remove tiny scratches and irregularities in the enamel surfaces.

In one embodiment, the buffing material presents a thin buffing material formed as a sack with drawstrings or tails and mounts to the handle without the need for the pad. User applies pressure according to the condition of the teeth. The process requires a few strokes on each surface or until the desired smoothness is achieved.

Various features and embodiments of an apparatus for buffing teeth are explained in conjunction with the description of FIGS. 1A to 10B.

Figure 1B:
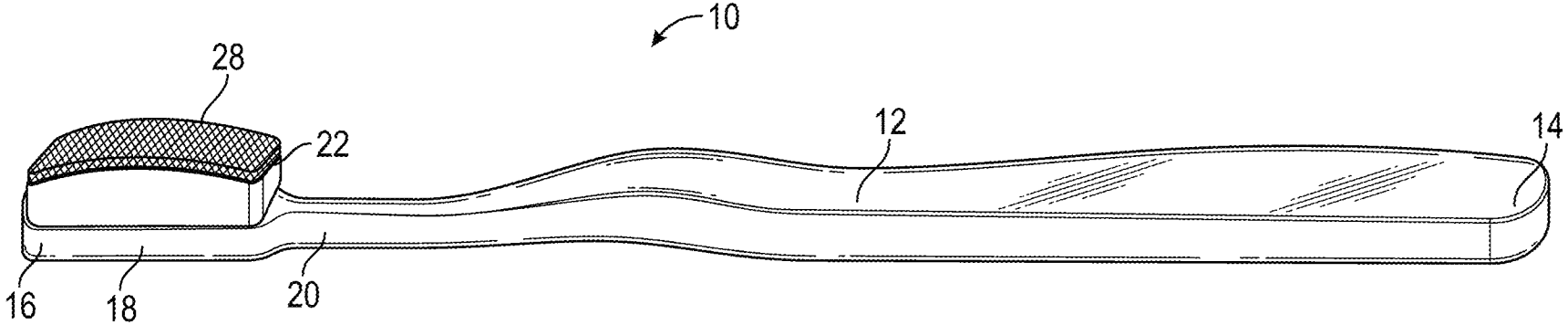

In one embodiment, the present invention discloses an apparatus that presents a slightly abrasive surface to rub against teeth to smooth their surfaces, herein and henceforth called "buffing" teeth. FIGS. 1A and 1B show an exploded and a perspective view of apparatus 10. Apparatus 10 includes handle 12. Handle 12 resembles a handle of a toothbrush as known in the art. Person skilled in the art will appreciate that FIGS. 1A and 1B show an exemplary shape of handle 12. However, handle 12 may have different shape and size depending on the need. Handle 12 provides material made of plastic, ceramic, wood, bamboo, or any other suitable material. Different manufacturing techniques such as molding materials help in manufacturing handle 12. Handle 12 provides first end 14 and second end 16. First end 14 indicates a distal end. At second end 16, handle 12 includes head portion 18 and neck portion 20. Head portion 18 presents an flat, oval shape section with suitable thickness. Person skilled in the art will appreciate that head portion 18 presents other shapes depending on the need. Preferably, head portion 18 presents a structure with curved, smooth edges such that apparatus 10 does not cause an injury inside the user's mouth when used for buffing teeth.

Apparatus 10 includes pad 22. Pad 22 provides material made of plastic, rubber, or any other suitable material. Pad 22 provides material having firm properties with varied thickness. Pad 22 provides material that does not absorb water or moisture. In other words, pad 22 is not susceptible to water or moisture absorption, herein and henceforth called "hydrophobic." Person skilled in the art will appreciate that pad 22 comes in different shapes and sizes. In the current implementation, pad 22 has a size similar to that of head portion 18 of handle 12. However, person skilled in the art will appreciate that pad 22 comes in different shapes and sizes depending on the need. In one example, pad 22 has a thickness of approximately $\frac{1}{8}^{th}$ inches. In one embodiment, pad 22 presents bottom portion 24 and top portion 26. Bottom portion 24 has a flat configuration. Bottom portion 24 provides material having stiff or rigid configuration. In one example, bottom portion 24 includes a support member (not shown) such as a metal plate. The support member mounts to bottom portion 24 and allows connecting pad 22 to handle 12. In one example, the support member connects to handle 12 using known mechanisms such as adhesive or fastener. Alternatively, bottom portion 24 of pad 22 directly connects to handle 12 using known mechanisms such as adhesive or clips of various configurations without the need for the support member.

Top portion 26 of pad 22 may have a variety of shapes. In one example, top portion 26 may have a flat surface. In another example, top portion 26 may have a concave surface. In another example, top portion 26 may have a convex surface. In another example, top portion 26 may have a wave-like surface/structure. FIG. 1A shows pad 22 having a convex surface at top surface 26.

Apparatus 10 further includes buffing material 28. Buffing material 28 provides material made of a cloth or cloth-like material. In one example, buffing material 28 provides material made of a synthetic material. In other example, buffing material 28 provides material made of a cotton terrycloth or cotton muslin. In other words, buffing material 28 provides material made of cloth or leather, polyvinyl acetal sponge, and a non-woven or synthetic porous material. Buffing material 28 provides material such as cloth of various textures, which allows to buff out scratches incurred by cleaning the teeth with a brush: Buffing material 28 possesses properties such as elasticity and flexibility, which does not scratch the surface (teeth) to be buffed. In the current implementation, buffing material 28 mounts to pad 22 at top surface 26. In one example, buffing material 24 mounts to pad 22 using adhesive or any other known mechanism.

FIG. 1B shows a side perspective view of apparatus 10, in accordance with one embodiment of present invention. As specified above, FIG. 1A shows top surface 26 having a convex surface. As such, buffing material 28 takes the shape of top surface 26 when mounted to pad 22. Subsequently, pad 22 mounts to handle 12 at the head portion 18. In one example, pad 22 mounts to head portion 18 using adhesive or glue. In another example, pad 22 mounts to head portion 18 using a fastener or any other known mechanism. Person skilled in the art will appreciate that pad 22 removably mounts to head portion 18. As a result, pad 22 allows for easy removal and cleaning. After cleaning, pad 22 connects to handle 12. In one exemplary implementation, user replaces old pad 22 with a new pad 22 after using old pad 22 until it ceases to accomplish the buffing or become unclean.

In order to buff teeth, a user uses apparatus 10 after brushing the teeth with a toothbrush and flossing between the teeth. User uses apparatus 10 in a dry or wet condition. Using the apparatus 10 in wet condition requires more strokes. The apparatus 10 does not lose buffing efficacy even when used in wet condition. At first, the user places buffing material 28 against the teeth with the help of handle 12. Subsequently, the user applies required pressure and moves handle 12 such that buffing material 28 moves back and forth (strokes) over the surface of the teeth to remove tiny scratches the toothbrush would have left on the surface of the enamel. Buffing the teeth with buffing material 28 removes the tiny scratches and results in the teeth becoming smoother. The user repeats the above process for buffing all of the teeth on all three surfaces of the enamel. Buffing after brushing the teeth reduces stains and shines the teeth. Buffing ensures no damage to the gum and stimulates blood circulation in the gum. As buffing removes the scratches, the chance of retaining biological organisms, acids, corrosive substances, and other undesired substances on the surface of the teeth reduces.

In one alternate embodiment, head portion 18 inserts into a sack of buffing material 28 having a section to receive head portion 18. Head portion 18 inserts into the section and a string from buffing material 28 helps to tie buffing material 28 to head portion 28. Alternatively, buffing material 24 includes material made in strips having ends. Here, head portion 18 encompasses slots. The slots in head portion receive the strips 18 and secure buffing material 28 to head portion 28.

Figure 2A:
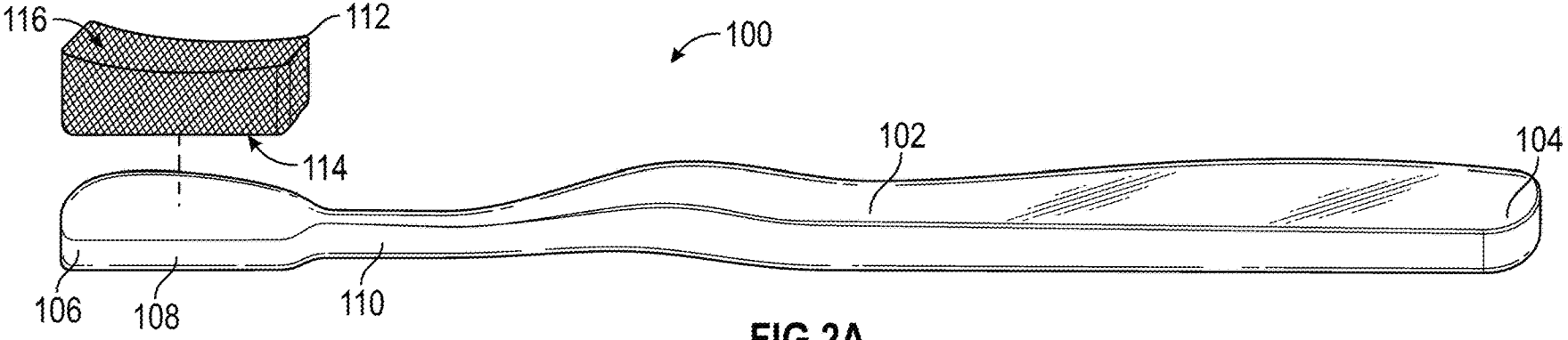
Figure 2B:
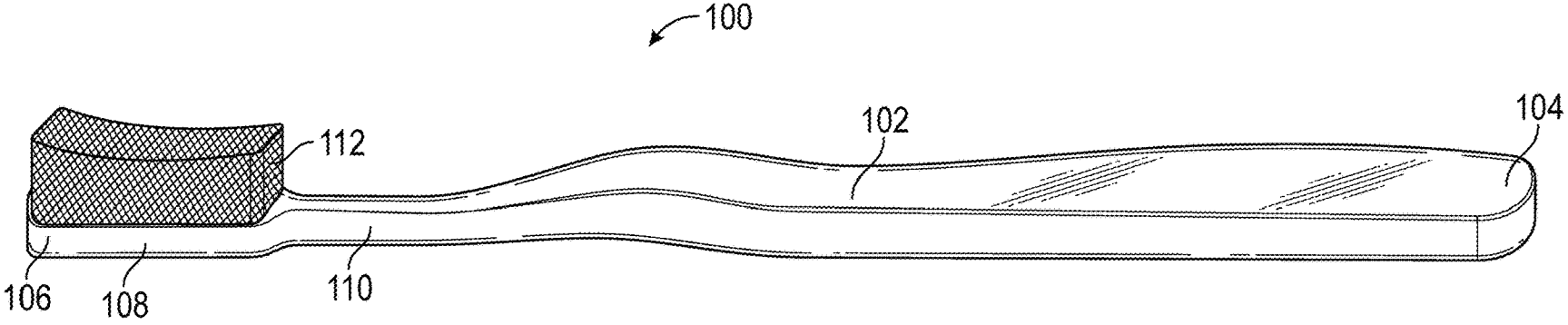

FIGS. 2A and 2B show apparatus 100 for buffing and/or washing teeth, in accordance with another embodiment of the present invention. FIG. 2A and 2B show an exploded view and a side perspective view of apparatus 100, respectively. In the current embodiment, apparatus 100 includes handle 102. Handle 102 presents an elongated body having suitable length. Handle 102 provides first end 104 and second end 106. First end 104 indicates a distal end. At second end 106, handle 102 provides head portion 108 and neck portion 110. In one example, head portion 108 presents an oval shape section with suitable thickness. Person skilled in the art will appreciate that head portion 108 presents other shapes depending on the need.

Apparatus 100 further includes buffing material 112. Buffing material 112 removably mounts to handle 102 at head portion 108. Person skilled in the art will appreciate that buffing material 112 comes in different shapes and sizes depending on the need. In the current implementation, buffing material 112 has a size similar to that of head portion 108. Buffing material 112 provides material made of a cloth or cloth-like material. In one example, buffing material 112 provides material made of a synthetic material. In other example, buffing material 112 provides material made of a cotton terrycloth or cotton muslin. In other words, buffing material 112 provides material made of cloth or leather, polyvinyl acetal sponge, and a non-woven or synthetic porous material that conform to the surface being buffed.

In the current embodiment, buffing material 112 has a thicker configuration. Here, bottom portion 114 of buffing material 112 has a flat configuration. Bottom portion 114 has flat configuration and stiff or rigid structure and allows mounting to head portion 108. In one example, bottom portion 114 includes a support member (not shown) such as a metal plate. The support member mounts to buffing material 112 at bottom portion 114 using known mechanisms such as adhesive or fastener. The support member mounts to bottom portion 114 and allows connecting buffing material 112 to handle 108. In one implementation, buffing material 112 removably mounts to handle 102 directly at the head portion 108 without the need for a support member.

Top portion 116 of buffing material 112 has a variety of shapes. In one example, top portion 116 may have a flat surface. In another example, top portion 116 may have a concave surface. In another example, top portion 116 may have a convex surface. In another example, top portion 116 may have a wave-like surface. FIG. 2A shows buffing material 112 having a convex surface at its top portion 116.

In order to buff teeth, a user uses apparatus 100 after brushing the teeth with a toothbrush and flossing between the teeth. The user places buffing material 112 against the teeth with the help of handle 102. The user moves apparatus 100 back and forth with the buffing material 112 held against the surface of the teeth using the desired and effective amount of pressure on the teeth to remove tiny scratches and irregularities on the surface of the enamel making the teeth smoother. It should be understood that the current embodiment explains use of apparatus 100 without the need of pad as explained above with the help of FIGS. 1A and 1B.

In one implementation, apparatus 100 allows the user to use it as a tooth washer i.e., to wash the teeth. In such implementation, buffing material 112 such as terrycloth mounts to handle 102. The terrycloth mounts to the handle 102 in thick layer configuration in the shape of a tooth. Buffing material 112 allows to use the apparatus 100 in a wet condition with toothpaste or other dentifrice to wash the teeth.

Figure 3:
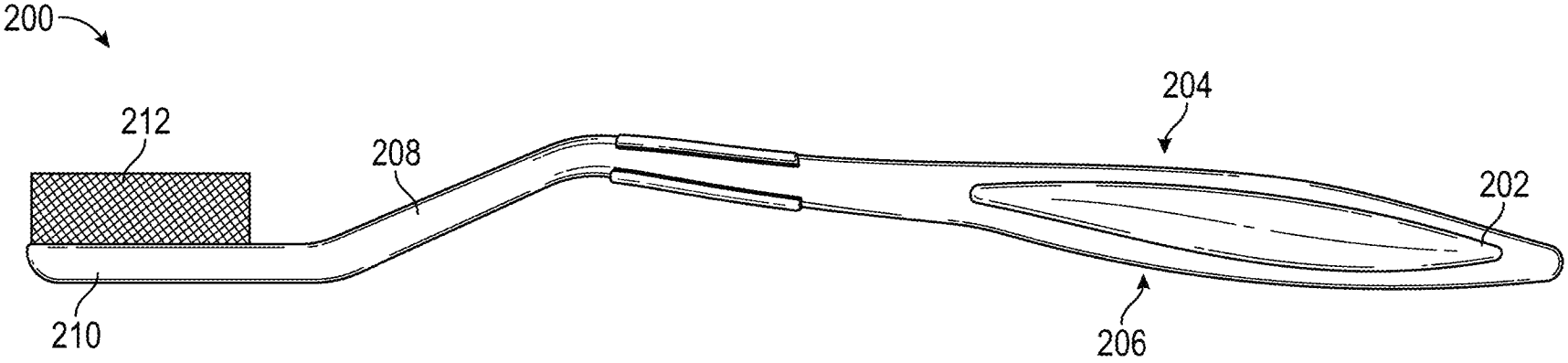
FIGS. 3 and 4 illustrate various embodiments of an apparatus comprising a handle in offset configuration and a buffing material mounted to the handle.

FIG. 3 shows a side view of apparatus 200 for buffing teeth, in accordance with another embodiment of the present invention. Apparatus 200 includes handle 202. Handle 202 presents an elongated body having suitable length. Handle 202 provides first side 204 and second side 206. First side 204 indicates a top surface or top portion of handle 202 and second side 206 indicates a bottom surface or bottom portion of handle 202. Handle 202 includes neck portion 208. The current embodiment illustrates neck portion 208 that bends or offsets with respect to handle 202.

Apparatus 200 includes buffing material 212. Buffing material 212 consists of fibrous material. In one example, buffing material 212 provides material made of synthetic material, cotton terrycloth or cotton muslin or other material. As presented above, buffing material 212 has a thick configuration such that its bottom surface has a flat surface and its top surface has one of flat, concave or convex surface. In the current embodiment, buffing material 212 has a flat surface at its top surface. However, person skilled in the art will appreciate that the top surface may have a concave or convex surface. Buffing material 212 removably mounts to handle 202 at head portion 208. FIG. 3 shows buffing material 212 that mounts at the first side 204 i.e., top surface of handle 202. Apparatus 200 having buffing material 212 that connects to handle 202 provides an advantage. Here, buffing material 212 directly contacts the surface of the teeth firmly and buffs out the scratches incurred by cleaning the teeth with a brush. Buffing material 212 allows usage in dry conditions. However, buffing material 212 helps to buff out the scratches even it wet conditions.

Figure 4:
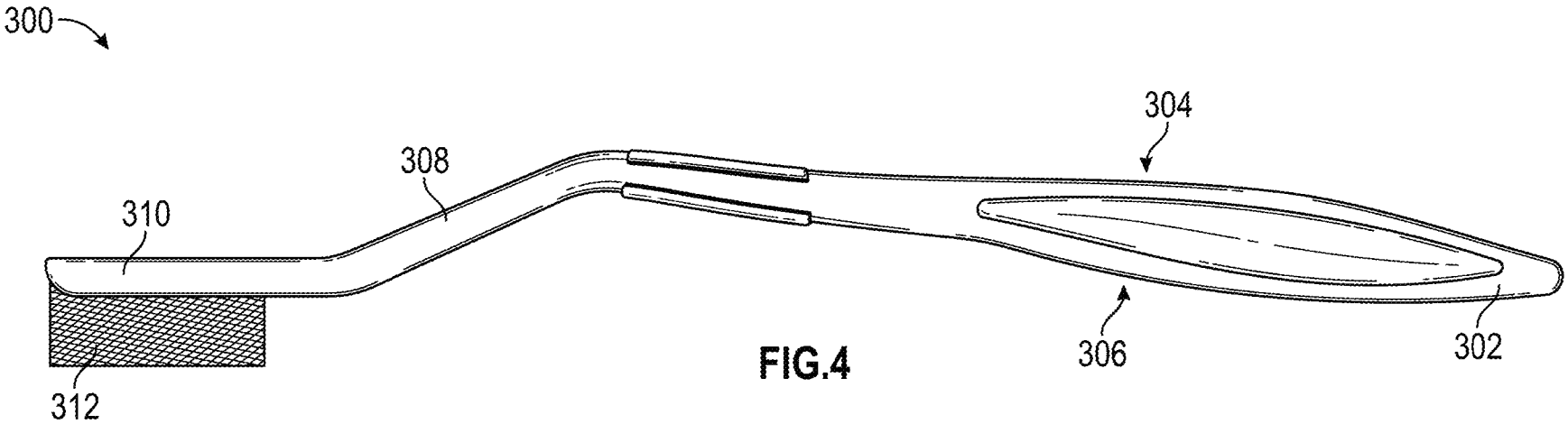

FIG. 4 shows a side view of apparatus 300 for buffing teeth, in accordance with another embodiment of the present invention. Apparatus 300 includes handle 302. Handle 302 provides an elongated body having suitable length. Handle 302 provides first side 304 and second side 306. First side 304 indicates a top surface of handle 302 and second side 306 indicates a bottom surface of handle 302. Handle 302 includes neck portion 308. The current embodiment shows neck portion 308 that bends or offsets with respect to handle 302.

Apparatus 300 includes buffing material 312. Buffing material 312 consists of a cloth or cloth-like material. In one example, buffing material 312 provides material made of synthetic material, cotton terrycloth or cotton muslin or other material. As presented above, buffing material 312 has a thick configuration such that its bottom surface has a flat surface and its top surface has one of flat, concave or convex surface. In the current embodiment, buffing material 312 has a flat surface at its top surface. However, person skilled in the art appreciates that the top surface may have a concave or convex surface. Buffing material 312 removably mounts to handle 302 at head portion 308. FIG. 4 shows buffing material 312 that mounts at second side 306 i.e., bottom surface of handle 302.

FIGS. 3 and 4 illustrate different configurations of handle and placement of buffing material on the handle. As such, the user may place the buffing material on the handle i.e., either at top or bottom surface depending on the need. In one example, the user may place the buffing material at the bottom surface of the handle for buffing inside of teeth. Alternatively, the user may place the buffing material at the top surface of the handle for buffing outside of teeth. Additionally, the user may choose the shape of the buffing material to be flat, concave or convex at its top surface depending on the need.

Alternatively, apparatuses shown in FIGS. 3 and 4 may include a pad between the handle and buffing material, as explained using FIGS. 1A and 1B. The pad allows the buffing material to take the shape of the pad as explained using FIGS. 1A and 1B. Thus, the buffing material mounts to handle in a variety of configurations and allows the user to use it with or without the need of a pad for buffing the teeth.

Figure 5A:
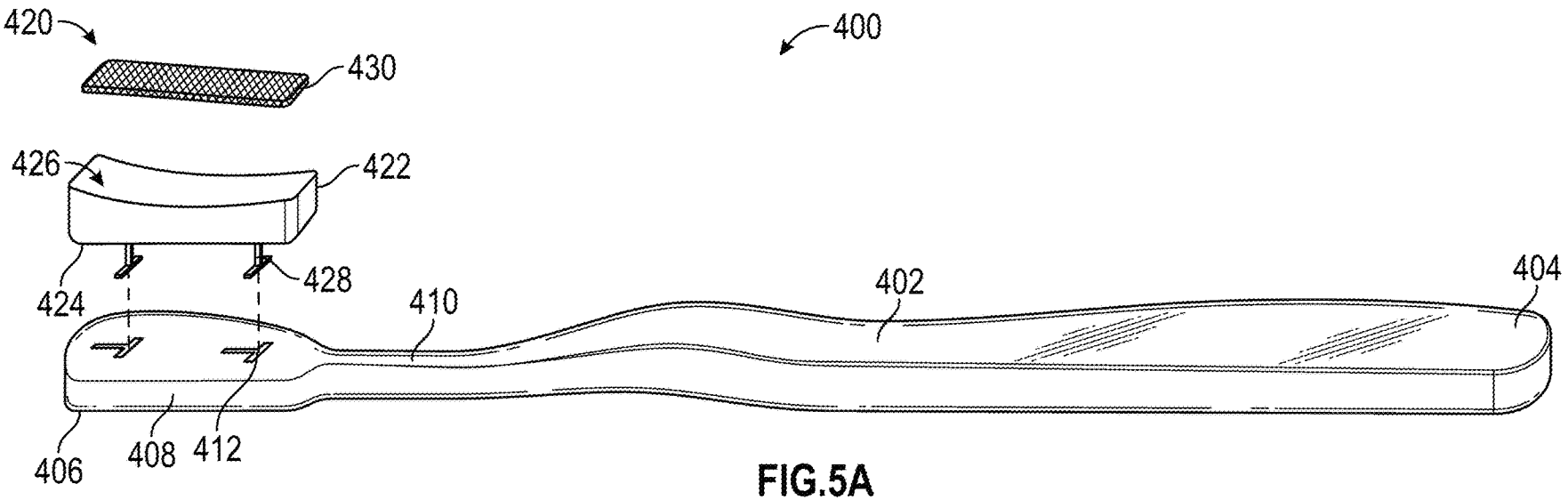
FIGS. 5A and 5B illustrate an exploded and a side perspective view, respectively of an apparatus for buffing teeth, in accordance with yet another embodiment of present invention.
Figure 5B:
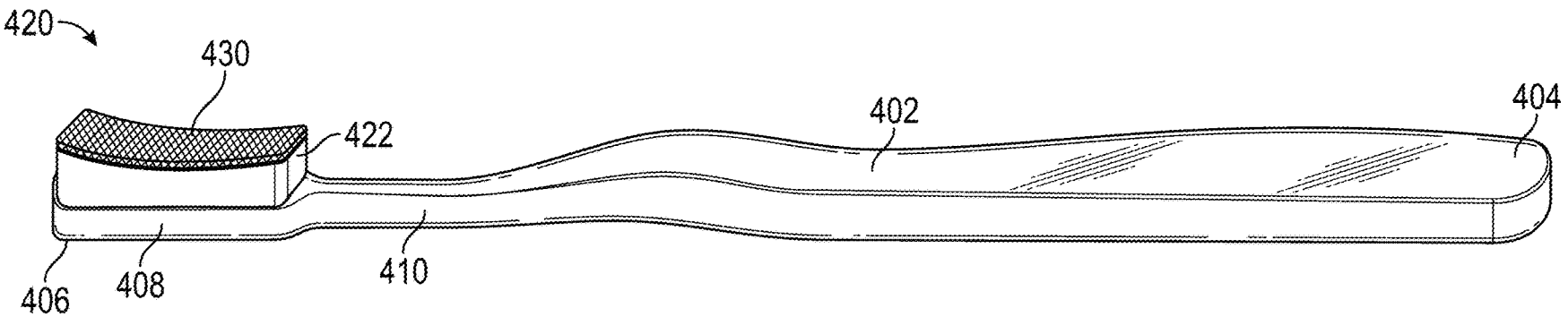

FIGS. 5A and 5B show an exploded view and a side perspective view, respectively of apparatus 400 for buffing teeth, in accordance with another embodiment of the present invention. Apparatus 400 includes handle 402. Handle 402 provides an elongated body having suitable length. Handle 402 provides material made of plastic, wood, or any other material. Handle 402 has first end 404 and second end 406. At second end 406, handle 402 includes head portion 408 and neck portion 410. In one example, head portion 408 presents an oval shape section with suitable thickness. Person skilled in the art will appreciate that head portion 408 presents other shapes depending on the need. Head portion 408 encompasses at least one female member 412. In the current embodiment, head portion 408 encompasses two female members 412, as shown in FIG. 5A. Female member 412 indicates a hole provided at head portion 408. In one example, each of the female members 412 has a T-shape hole/groove. In another example, female member 412 may have holes in any other shape.

Apparatus 400 further includes buffing material attachment 420. Buffing material attachment 420 includes pad 422 and buffing material 430. Pad 422 provides material having firm properties. Pad 422 provides material that does not absorb water or moisture. In one example, pad 422 has bottom portion 424 and top portion 426. Bottom portion 424 has a flat configuration. Top portion 426 has one of flat, concave and convex surface/configuration. In one example, bottom portion 424 has a stiff or rigid configuration. In another example, bottom portion 424 provides a support member (not shown) such as a metal plate. Support member mounts to pad 422 using known mechanisms such as adhesive or fastener. Alternatively, handle 402 includes the support member that allows connecting bottom portion 424 to handle 402.

Bottom portion 424 provides at least one male member 428. In the current embodiment, pad 422 provides two male members 428. Male member 428 indicates a protrusion or extension or hook that extends from bottom portion 424. In one example, each of the male members 426 provides a T-shape protrusion. In another example, male member 412 may have any other shape. Person skilled in the art will appreciate that male members 428 insert into female members 412 provided at head portion 408 to mount pad 422 to handle 402.

Buffing material 430 mounts at top portion 426 of pad 422. Buffing material 430 mounts to pad 422 using adhesive or any other known mechanism. As specified above, buffing material 430 provides material made of a variety of fibrous materials. In one example, buffing material 430 provides material made of synthetic material or cotton terrycloth or cotton muslin or hemp.

In order to mount buffing material attachment 420 to handle 402, at first, buffing material 430 mounts on top portion 426 of pad 422. Buffing material 430 takes the shape of top portion 426. In the current embodiment, buffing material 430 takes the concave shape at its top surface. After mounting buffing material 430, pad 422 mounts to handle 402 at head portion 408. As explained above, male members 426 insert into female members 412 to mount pad 422 to handle 402.

In one alternate embodiment, head portion 408 includes female members 412 at its bottom surface, such that buffing material attachment 420 mounts at the bottom surface of head portion 408. This enables buffing material attachment 420 to removably mount to handle 402 either at the top or bottom of handle 402 for buffing inside and outside of the teeth.

Figure 6A:
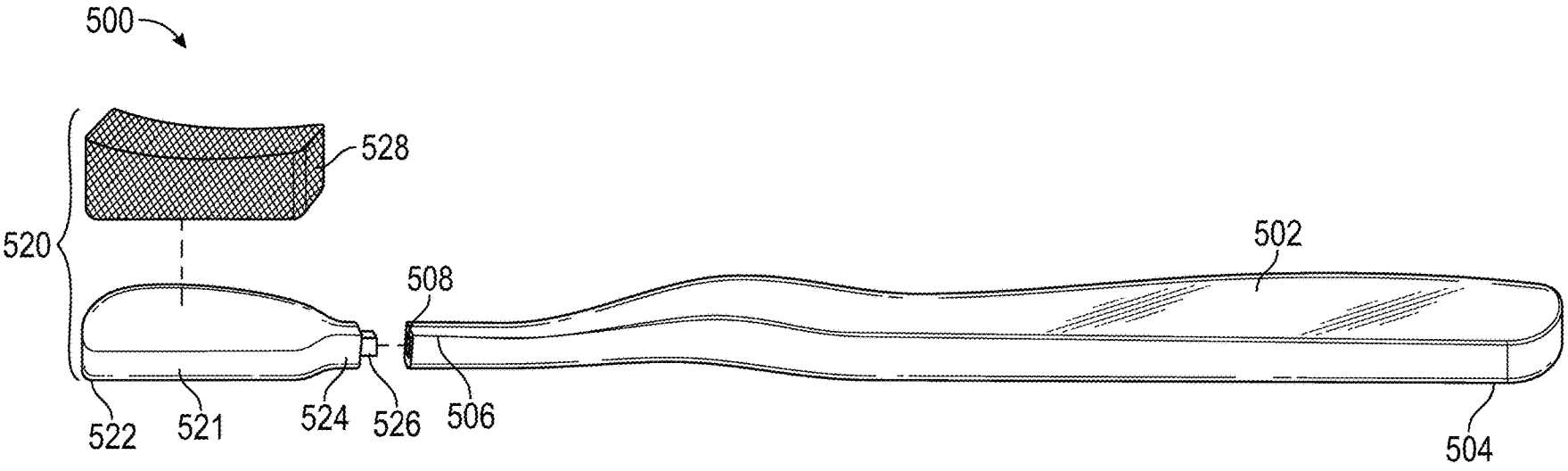
FIGS. 6A and 6B illustrate an exploded and a side perspective view, respectively of an apparatus for buffing teeth showing an attachment method, in accordance with yet another embodiment of present invention.
Figure 6B:
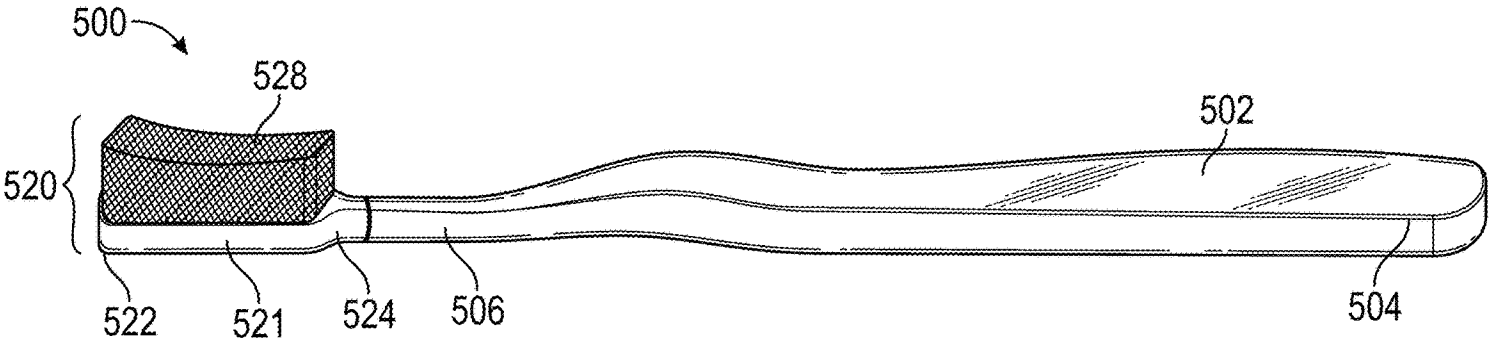

FIGS. 6A and 6B show an exploded view and a side perspective view, respectively of apparatus 500 for buffing teeth, in accordance with another embodiment of the present invention. Apparatus 500 includes handle 502. Handle 502 provides an elongated body having suitable length. Handle 502 provides material made of plastic, wood, or any other material. Handle 502 provides first end 504 and second end 506. At second end 506, handle 502 includes female member 508. Female member 508 indicates a hole or groove. In one example, female member 508 has a square or rectangular shape. In another example, female member 508 has circular or any other shape.

Apparatus 500 includes buffing material attachment 520. In the current embodiment, buffing material attachment 520 includes head portion 521. Head portion 521 provides material made of plastic, wood or any other suitable material. As specified above, head portion 521 comes in a variety of shapes and sizes. In the current embodiment, head portion 521 has oval shape i.e., similar to a head of a toothbrush. However, a person skilled in the art will understand that the shape of head portion 521 may come in any other shape. Head portion 521 provides third end 522 and fourth end 524. Head portion 521 includes male member 526 at fourth end 524. Male member 526 indicates a protrusion that extends from fourth end 524. In one example, male member 526 has rectangular configuration. Person skilled in the art understands that male member 526 has similar shape similar to female member 508 provided at handle 502. Male member 526 removably mounts to female member 508 using a known mechanism e.g., in a snap mechanism. Buffing material attachment 520 further includes buffing material 528. Here, shape of buffing material 528 appears similar to head portion 521. Buffing material 528 mounts at the top surface of head portion 521. Buffing material 528 mounts to head portion 521 using adhesive or any other known mechanism. As specified above, the buffing material 528 provides material made of a cloth or cloth-like material. In one example, buffing material 528 provides material made of synthetic material or cotton terrycloth or cotton muslin or hemp.

In order to mount buffing material attachment 520 to handle 502, at first, buffing material 528 mounts on the top of head portion 521. After mounting, buffing material 528 takes the shape of head portion 521. Here, buffing material 528 takes the shape of the head 521. In the example shown in FIG. 6A, head portion 521 has a flat surface. As such, bottom of buffing material 528 mounts flat to head portion 521. Further, the top of buffing material 528 has a concave surface. However, buffing material 528 may have any other shape e.g., flat or convex or wave-like structure. After mounting buffing material 528, head portion 521 mounts to handle 502. As specified above, male member 526 removably mounts to female member 508 using known mechanism e.g., in a snap mechanism. Specifically, male member 526 inserts into female member 508 and mounts head portion 521 to handle 502.

Figure 7:
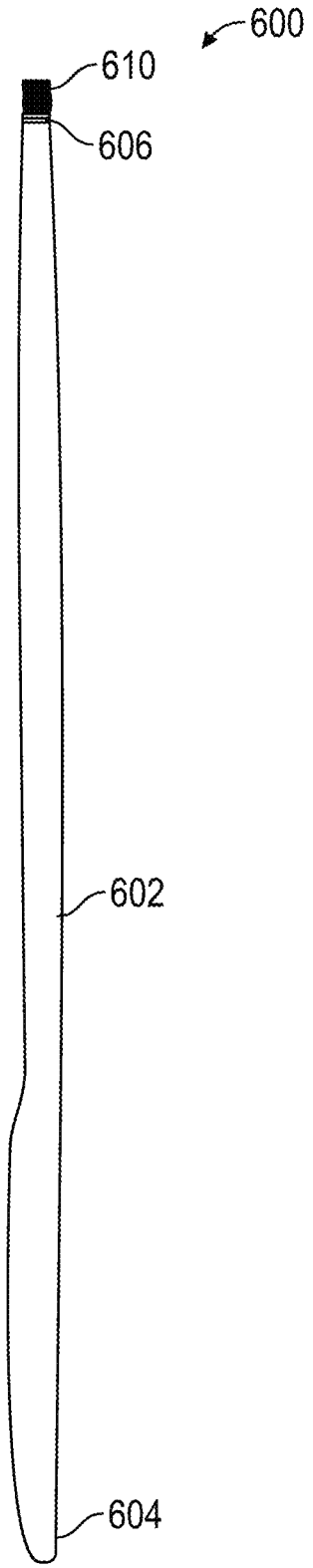
FIG. 7 illustrates a front view of an apparatus in which a handle is provided in a thin and elongated configuration, and a buffing material provided at one end of and perpendicular to the handle, in accordance with yet another embodiment of present invention.

FIG. 7 shows a front view of apparatus 600 for buffing teeth, in accordance with another embodiment of the present invention. Apparatus 600 includes handle 602. In the current embodiment, handle 602 presents a thin and elongated body. Handle 602 provides first end 604 and second end 606. Handle 602 provides buffing material 610 at second end 606. Buffing material 610 mounts to handle 602 using known mechanisms such as adhesive or glue or fastener. In one example, handle 602 has a thin and squared off end, over which buffing material 610 stretches and secures. Handle 602 provides material made of plastic or wood. In one example, a user applies pressure to stretch and secure buffing material 610 to handle 602. Apparatus 600 allows the user to buff area between the teeth and in specific areas that is otherwise not possible with other configurations.

Figure 8:
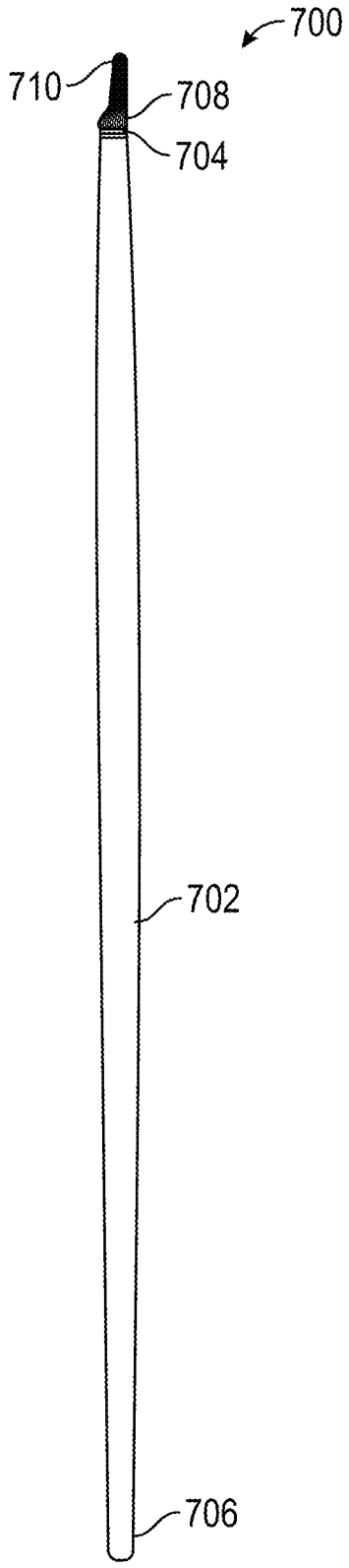
FIG. 8 illustrates a front view of an apparatus in which a handle is provided in a thin and elongated configuration, and a buffing material provided at one end of and perpendicular to the handle in bent or hooked or tip fashion, in accordance with yet another embodiment of present invention.

FIG. 8 shows a front view of apparatus 700 for buffing teeth, in accordance with another embodiment of the present invention. Apparatus 700 includes a handle 702. In the current embodiment, handle 702 provides a thin and elongated body. Handle 702 provides first end 704 and second end 706. Handle 702 provides buffing material 710 at second end 706. Buffing material 708 mounts to handle 702 using known mechanisms such as adhesive or glue. Here, buffing material 708 includes a bent or hooked or tip-like structure 710. A uses apparatus 700 to buff or clean the back of the teeth.

Figure 9:
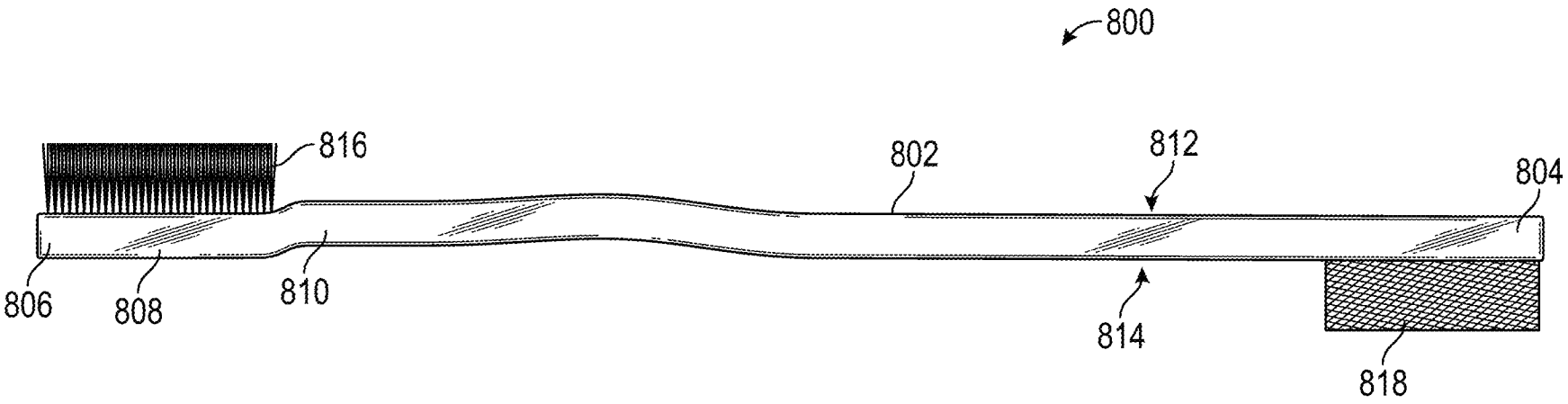
FIG. 9 illustrates a side view of an apparatus in which a handle comprising both bristles and a buffing material on either side of the handle, in accordance with yet another embodiment of present invention.

FIG. 9 shows a side view of an apparatus 800 for buffing and washing or cleaning teeth, in accordance with another embodiment of the present invention. Apparatus 800 includes handle 802. Handle 802 provides an elongated body having suitable length. Handle 802 presents first end 804 and second end 806. Handle 802 includes head portion 808 and neck portion 810. The current embodiment illustrates the shape of neck portion 810 that bends or offsets with respect to handle 802. Further, handle 802 provides first side 812 and second side 814. First side 812 indicates a top surface of handle 802 and second side 814 indicates a bottom surface of handle 802.

Handle 802 includes bristles 816 at second end 806 and first side 812. Bristles 816 indicate bristles or brush-like structure common with a toothbrush. Handle 802 provides buffing material 818 at first end 804 and second side 814. As specified above, buffing material 818 mounts to handle 802 using known mechanisms. Alternatively, buffing material 818 mounts with the help of a pad as explained above.

In the current implementation, apparatus 800 allows to brush or clean and to buff the teeth. Specifically, the user uses bristles 816 to brush the teeth similar to the toothbrush. Subsequently, user turns handle 802 and uses buffing material 818 to buff the teeth as explained above. It should be understood that placement of bristles 816 and buffing material 818 show illustrative embodiments. Person skilled in the art will appreciate that bristles 816 and buffing material 818 may interchange their position or placement depending on the need.

Figure 10A:
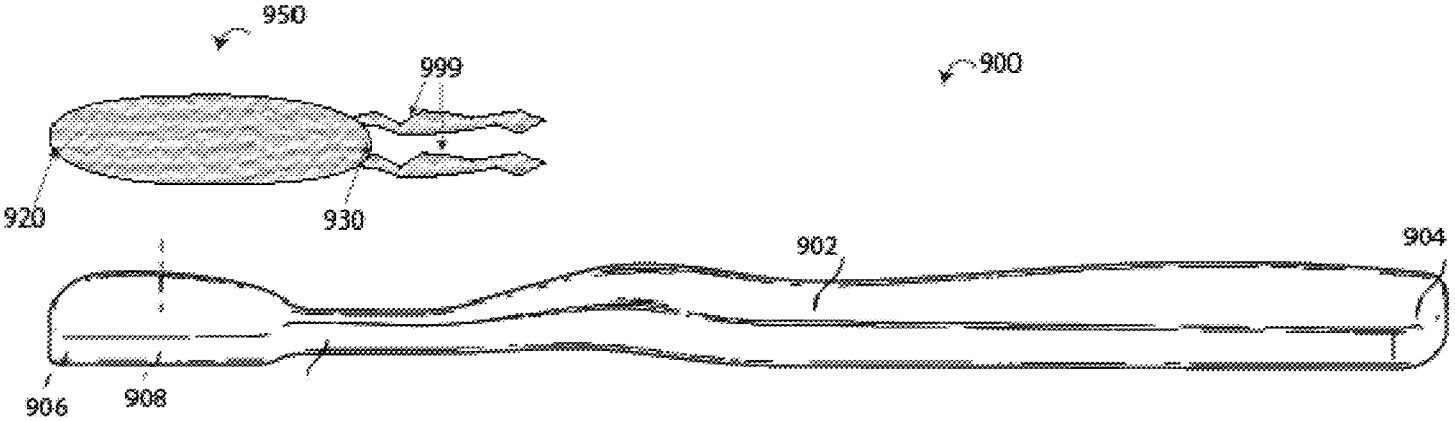
FIGS. 10A and 10B illustrate an exploded and a side perspective view, respectively of an apparatus for buffing teeth showing a buffing material attachment method in accordance with yet another embodiment of present invention.
Figure 10B:
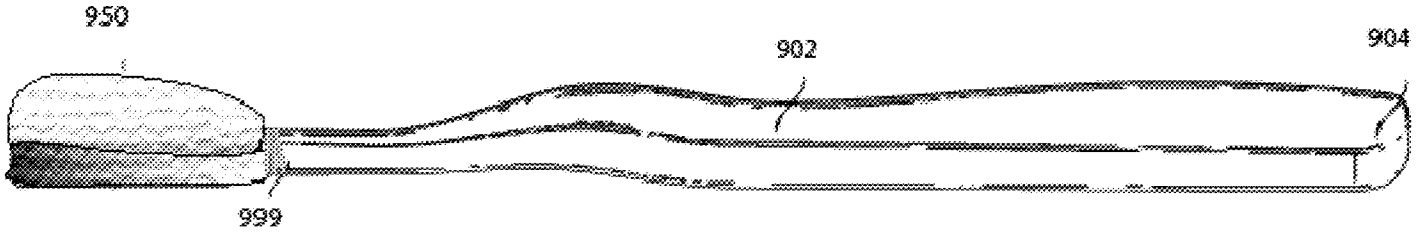

FIGS. 10A and 10B show apparatus 900 for buffing teeth in accordance with the original design by the inventor. FIGS. 10A and 10B show and exploded view and a side perspective view of apparatus 900 with buffing material sack 950 over the head portion 908 and tails 999 tied around neck section 910 respectively. Apparatus 900 resembles a toothbrush as known in the art. Where a toothbrush has bristles for brushing teeth, the current invention has a buffing material sack 950 around the entirety of the head portion 908 secured to the head portion by tails 999 of buffing material tied around the neck 910. FIG. 10A shows a buffing material sack 950 that includes tails 999 manufactured as extensions of the material of buffing material sack 950 suitable in length to allow tying around neck portion 910 thereby securing the buffing material sack 950 tightly to the head portion 908. Alternatively, the buffing material sack 950 has a drawstring running around the open end of the buffing material sack 950 inside a hemmed sleeve to use to secure the buffing material sack 950.

In the current embodiment, apparatus 900 includes handle 902. Handle 902 presents an elongated body having suitable length. Handle 902 provides first end 904 and second end 906. First end 904 indicates a distal end. At second end 906, handle 902 provides head portion 908 and neck portion 910. In one example, head portion 908 presents an oval shape section with suitable size and thickness. Persons skilled in the art will appreciate that the head portion 908 presents other possible shapes depending on the need.

Apparatus 900 further includes a buffing material sack 950 formed as a sack 950 with tails 999. In other words the buffing material sack 950 is formed as a tube or a sleeve of appripirate size. Buffing material sack 950 removably mounts to handle 902 at the head portion 908. Persons skilled in the art will appreciate that the buffing material sack 950 is manufactured of different material depending on the need.

In the current implementation, the buffing material sack 950 has a closed end 920 and an open end 930 from which tails 999 are extended. Tails 999 are of sufficient length to permit tying around the neck section 910. In another implementation the buffing material sack 950 has a drawstring that secures the buffing material sack 950 to the head portion 908 and ties around the neck section 910 securing the buffing material sack 950 tightly. When secured correctly, the buffing material sack 950 will not deform, distort, bunch, wrinkle, snag, splip, or move in any way. People skilled in the art appreciate that buffing requires a stable buffing material.

Further, the buffing material sack 950 receives the head portion 908 through the open end 930 and is pushed completely to the closed end 920. The material is pulled tight and tied. People familiar with the art appreciate that the buffing material sack 950 can be secured by other methods that do not constitute a new or different apparatus.

The buffing material sack 950 will have an inside width slightly less than the width of the head portion 908 and a length slightly less than the length of the head portion 908 that forces the buffing material sack 950 to draw down tightly to the head portion 908.

Buffing material to be formed into a sack with tails 999 at the open end 930. Tails to be formed of the same material as the buffing material sack 950 provides an opening through which the head 908 is fully inserted into the sack of buffing material 908 with tails 999 hanging loosely at the neck portion 910 to be tied to the neck portion 910. To secure the tails 999 and hold them out of the way, in other words to prevent them from hanging loos, a rubber band can be used or the tails 999 can be tied in a way that secured the ends. Those familiar with the art appreciate the techniques useful in tying loos ends securely within the knot.

FIG. 10B shows a side view of the assembled apparatus 900. The buffing material sack surrounds the head 908 on all sides and is tied around the neck section 910. The apparatus constitutes an inexpensive buffing device suitable for all human teeth surfaces in all arrangements of human teeth. The buffing material sack 950 can be washed or replaced inexpensively as needed. Given the variety of dental work done to teeth, the current invention is useful and safe for all dental work but braces, retainers, bridges, and other dental appliance that can snag the devise. Fillings, crown, and implants will benefit by buffing after brushing and flossing.

Persons skilled in the art appreciate that user operates apparatus in a dry condition after brushing and flossing the teeth. Therefore, there is no need for using water for removing scratches and shining the teeth after brushing the teeth and flossing. Using the apparatus in a wet condition will not destroy the function of the apparatus, but it may cause the need to apply more pressure and buff longer. Either method works well and can be used as desired by the user. When compared to known polishing tools, buffing with the here disclosed apparatus ensures no damage to the gums and stimulates blood circulation in the gums. The apparatus reduces and removes stains, cleans and shines the teeth. The presently disclosed apparatus complements logical expression to clean, smooth, and shine the teeth without damaging the gums. As specified above, buffing ensures no scratches remain on the teeth. This ensures biological organisms, acids, corrosive substances, and other undesired substances do not get accumulated at the teeth and gums. In order words, buffing removes or reduces the chances of retaining biological organisms, acids, corrosive substances, and other undesired substances on the surface of the teeth.

It should be understood that the above embodiments explain the variety of ways in which the buffing material mounts to the handle for buffing and cleaning the teeth. However, person skilled in the art will appreciate that other ways of mounting the buffing material to handle for buffing inside and outside of the teeth fall within the scope of the present invention. In one example, the buffing material provides a sack having a drawstring. The drawstring slips over the end and allows it to tie around the handle. In another example, the buffing material provides a strip that allows it to put its ends through slots provided in the handle to grip the buffing material. In another example, the handle includes clips. The clips hold the strip of the buffing material. In another example, the handle has a rectangular opening. A portion of the buffing material goes into the rectangular opening and allows the exposed buffing material to buff the teeth.

The apparatus comprising the handle, neck, head, pad, and the buffing material may come as a single product. Alternatively, the buffing material attachment comprising the pads of different configuration i.e., flat, concave and convex surface and the buffing material may come separately such that the whole head and buffing material attachment removably mounts to the neck. The user selects the pad based on the need. After use over certain time, user may replace the buffing material attachment.

Although the embodiments explained require manually operating the apparatus to buff the teeth, the apparatus might be equipped with a motor, a battery or power cord and a tool coated or mounted with a buffing material. The tool oscillates, rotates and vibrates so as to buff the teeth using the buffing material. The apparatus provides actuators at the handle for operating the tool at varied speed.

A person skilled in the art will appreciate that apparatus complements brushing teeth. Specifically, the presently disclosed apparatus gently smoothens the micro-abrasions caused by a toothbrush or other causes. The apparatus provides simple design and takes very little time to complete the buffing process. The apparatus results in a smoother tooth surface that is easily detected by passing the tongue over the teeth after brushing and then after buffing The apparatus makes the teeth smoother and thereby makes the teeth to stay clean for a longer time. The buffing material reduces bacterial retention by removing the extra surface area of the tooth that is created by micro-abrasions put into the surface by the bristles in a brush. The apparatus is easier to use and is not large enough to cause a gag reflex like other devices that are designed to place over a finger, or the ones that are round, or ones that are designed to go over the tooth entirely on all three sides. The presently disclosed apparatus is less gagging when compared with known devices that have buffing material on, opposing sides. The apparatus applies buffing material to both sides of the handle in one iteration that is small and thin enough to be comfortable and convenient in the area toward the back of the mouth where the check is close to the teeth. In other iterations the apparatus has buffing material on one side in the same way a toothbrush has bristles on one side making it more comfortable and pleasant to use as compared to the other devices available.

It should be understood that the shape, size and placement of each component shown in figures are provided for illustrative purposes only and should not be construed in a limited sense. A person skilled in the art will appreciate alternate parts and/or mechanisms that might be used to implement the embodiments of the present invention and such implementations will be within the scope of the present invention.

The presently disclosed apparatus is being marketed as "Tooth Buff" or "Toothbuff™" or "Tooth Shiner". However, there is no intention on part of the Applicant to limit the scope of the apparatus's branding to "Tooth buff" or "Tooth Shiner" to advertise or market the apparatus. Applicant may refer to the apparatus as he may seem fit, without such reference limiting the scope of the present disclosure or claims herein or otherwise affecting related patent rights he may derive from this or other patent application filings.

In the above description, numerous specific details are set forth such as examples of some embodiments, specific components, devices, methods, in order to provide a thorough understanding of embodiments of the present invention. It will be apparent to a person of ordinary skill in the art that these specific details need not be employed, and should not be construed to limit the scope of the invention.

In the development of any actual implementation, numerous implementation-specific decisions must be made to achieve the developer's specific goals, such as compliance with system-related and business-related constraints. Such a development effort might be complex and time-consuming, but may nevertheless be a routine undertaking of design, fabrication, and manufacture for those of ordinary skill. Hence as various changes could be made in the above constructions without departing from the scope of the invention, it is intended that all matter contained in the above description or shown in the accompanying drawings shall be interpreted as illustrative and not in a limiting sense.

The foregoing description of embodiments is provided to enable any person skilled in the art to make and use the invention. Various modifications to these embodiments will be readily apparent to those skilled in the art, and the novel principles and invention disclosed herein may be applied to other embodiments without the use of the innovative faculty. It is contemplated that additional embodiments are within the spirit and true scope of the disclosed invention.

The inventor envisions the apparatus arranged along side the toothbrush. Hanging in a toothbrush rack next to the toothbrush, the toothbuff, so named for convenience here, takes its rightful place in the array of instruments of personal care and hygiene of teeth. It will be so like the toothbrush, it will become felt to be as natural as toothbrushes in the home. Users need only grab a toothbrush, brush, floss, and grab the toothbuff and buff. It is natural.

What is claimed is:

1. A system for buffing teeth to smooth enamel surfaces of human teeth comprising:

a handle having a first end and a second end;

a strong neck section extending from the first end of the handle;

at least three head portions, each head portion having a male part formed thereon to connect to a female part of the neck section; each head portion further comprising a head base;

a set of pads comprising at least one pad having a flat surface, at least one pad having a concave surface and at least one pad having a convex surface, wherein each pad is glued to a top surface of a corresponding one of the at least three head bases; and a set of buffing materials comprising terry cloth layers, each buffing material being tightly affixed or held tightly to each head portion to prevent movement between the buffing material and corresponding pad when the user places the buffing material against a surface of a tooth or the teeth that are being buffed, applies force against the tooth or teeth, and moves up and down against the surfaces of the teeth to move tooth enamel and remove scratches left behind by brushing or previous cleaning.

2. The system of claim 1, wherein at least one of the terry cloth layers is smooth throughout to prevent scratching tooth enamel.

3. The system of claim 1, wherein the handle, the neck sections, head portions, and pads are is hydrophobic.

4. The system of claim 1, a. said buffing materials formed as a thin, nondeformable material, and b. said buffing materials not subject to lateral movement that defeats the effort required to buff the teeth.

5. The system of claim 1, wherein said handle is constructed of plastic, hard rubber, wood, or other suitable materials;

a. said handle constructed flat with rounded oval, square, rectangular, or other suitable shapes, and b. said handle constructed with gripping structures to prevent slippage.

6. The system of claim 1, wherein said neck section is smaller and more streamlined than said handle and head portions;

a. said neck portion comprises one of a round, oval, or other suitable shape in cross-section;

b. the neck section comprises a length of 1.5 to 2 inches long;

c. said head portions each comprising a flat, rounded rectangle or oval from 1 to 1.5 inches long, about 0.5 inches wide, and 0.3 inches thick, the dimensions selected to accommodate forces necessary to buff enamel of teeth and sized to suit mouths and arrangements of teeth.

7. The system of claim 1, wherein one of the buffing materials is a tight-fitting sack; wherein a. wherein one of said head portions that is passed inside the tight-fitting sack of thin buffing material that is stretched tightly along the longitudinal axis of said head portion and tightly tied around said neck section to prevent any distortion, snagging, bunching, wrinkling, or movement of any type;

b. said buffing material sack having one of drawstrings or tails of the buffing material at the open end long enough to tie around the neck section apparatus securing the material tightly on the head portion;

i. said tails or drawstrings tied to entrap the ends, or ii. said tails or drawstrings ends secured by a rubber band ring, 1. said rubber band ring to be small enough to secure the drawstrings or tails material, 2. said rubber band ring about 0.2 to 0.3 inches wide, 3. said rubber band ring to fit tightly to said neck section, and e. said buffing material comprising a thickness to provide a slight conforming characteristic to shape it slightly to the shape of the surface to be buffed.

8. The system of claim 1, wherein the pads are made of hydrophobic material comprising hard rubber, plastic, bamboo, wood, or any other suitable material; wherein the pad is between one and two inches long, one-eighth of an inch to one-half inch wide; and wherein said handle and said neck section are made of wood, bamboo, plastic, or other hydrophobic materials.

9. The system of claim 1, wherein said head portions are free of bristles or sharp or abrasive material.

10. The system of claim 1, wherein said pads comprises various shapes;

a. said head portion comprising said pads that raises said buffing material above said handle to accommodate the different buffing surface shapes;

the height said set of pads raises said buffing material above said handle a distance determined by a curvature, where there is curvature, of said top surface of said pad.

11. The system of claim 1, wherein said handle comprises bristles at the second end, the bristles being configured to brush teeth.

12. The system of claim 1, wherein at least one of said buffing materials removably connects to said handle in a bent or tip configuration to buff or clean areas rear of back molars or wisdom teeth.

13. The system of claim 1, a. wherein said buffing materials are washable;

b. wherein said handle, neck section, and said head portions are washable.

* * * * *